United States Patent [19]

Naruse

[11] Patent Number: 4,754,440

[45] Date of Patent: Jun. 28, 1988

[54] ULTRASONIC TRANSDUCER

[75] Inventor: Yoshihiro Naruse, Tokyo, Japan

[73] Assignee: Aisin Seiki Kabushikikaisha, Japan

[21] Appl. No.: 944,309

[22] Filed: Dec. 22, 1986

[30] Foreign Application Priority Data

Dec. 27, 1985 [JP] Japan ..... 60-202283[U]
Feb. 19, 1986 [JP] Japan ..... 61-22439[U]

[51] Int. Cl.[4] ..... H04R 1/02

[52] U.S. Cl. ..... 367/140; 367/188; 181/148; 381/190; 381/202

[58] Field of Search ..... 181/139, 140, 141, 142, 181/206, 210, 148; 340/901, 902, 903, 904, 943; 367/87, 88, 91, 157, 140, 173, 174, 176, 188, 909; 73/632; 381/159, 173, 190, 202, 204, 205

[56] References Cited

U.S. PATENT DOCUMENTS 3,100,292 8/1963 Warner, Jr. et al. ..... 367/185
3,158,835 11/1964 Hipkins ..... 340/902
4,542,489 9/1985 Naruse ..... 367/93
4,636,997 1/1987 Toyama et al. ..... 367/140
4,695,985 9/1987 Takeoka ..... 367/140 X

FOREIGN PATENT DOCUMENTS 0047196 4/1981 Japan ..... 367/140

*Primary Examiner*—Deborah L. Kyle
*Assistant Examiner*—Brian S. Steinberger
*Attorney, Agent, or Firm*—Sughrue, Mion, Zinn, Macpeak, and Seas

[57] ABSTRACT

A transducer includes a cup-shaped diaphragm having a planar portion in the form of a flange. The internal space of the cup is closed by a metallic support plate. A disc-shaped piezoelectric element has electrode layers on its front and rear surfaces, and the front electrode layer is joined to the inner bottom of the cup. An electrical lead is connected to the rear electrode layer of the piezoelectric element and extends along the external surface of the support plate after it is passed through the thickness of the plate and then bent at a right angle. A resilient member is joined to the external surface of the support plate, and an aluminium sheet is joined to the resilient member. The diaphragm is connected to the ground through the support plate, and the aluminium sheet is also connected to the ground.

6 Claims, 6 Drawing Sheets

ULTRASONIC TRANSDUCER

FIELD OF THE INVENTION

The invention relates to an ultrasonic transducer which produces ultrasonic waves in response to an electrical energization or produces an electrical signal in response to ultrasonic waves.

BACKGROUND OF THE INVENTION

An ultrasonic transducer is known in the art and comprises a diaphragm secured to a voltage/oscillation transducer element which converts an electric voltage into a mechanical displacement which may be a change in the configuration or position or alternatively converts a pressure into an electric voltage.

FIG. 8 shows one exemplary ultrasonic transducer of the prior art. Specifically, there is provided a cup-shaped metallic diaphragm 1, to the internal surface of which is joined a voltage/oscillation transducer element 2 with its one electrode disposed in contact with the diaphragm 1. The element 2 comprises a piezoelectric element which becomes deformed in response to the application a voltage thereacross and which develops a voltage in response to the application of a pressure thereto. The other electrode of the element 2 is connected to one end of an electrical lead 3, the other end of which is connected to a terminal pin 4. The diaphragm 1 is connected to one end of another electrical lead 5, the other end of which is connected to a terminal pin 6.

A metal cap 7 is coated upon the bottom surface of a mount 8 of an insulating material, which is provided with a flange on its upper surface, to which a resilient member 9 in the form of an O-ring is joined. An O-ring 10 is fitted around the top end of the mount, and the assembly is fitted into the opening of the diaphragm 1, with its edge crimped into an annular configuration 11, thus securing the diaphragm 1 and the mount 8 together in an integral manner. The resilient member 9 and the O-ring 10 are effective to provide a water tight seal between the diaphragm 1 and the mount 8 to prevent the ingress of dust or liquid, typically water, while avoiding an interference with the oscillation of the diaphragm 1. When a voltage of ultrasonic frequency is applied across the terminal pins 4, 6, the element 2 expands and shrinks in the diametrical direction with the same frequency, whereby the diaphragm 1 oscillates, producing ultrasonic wave internally and externally of the diaphragm 1.

One example of the use of such ultrasonic transducer is illustrated in FIG. 9*a*. In this instance, an ultrasonic transducer is mounted on a rear bumper BR of a vehicle in order to detect the presence or absence of any obstacle adjacent to the rear portion of the vehicle and also to detect the distance to such obstacle. In the example shown, one transducer is used to transmit ultrasonic waves, and the reflected ultrasonic waves are detected by one or more additional transducers. In a different mode of use, the same transducer which transmits ultrasonic waves may be used to detect a reflected wave.

FIG. 9*b* shows a cross section of a base 12 on which transducers are mounted. In order to avoid any influence of the mechanical vibrations of a car body upon the operation of the transducers, transmitting and receiving ultrasonic transducers $1_1$ and $1_2$ are secured to the base 12 with resilient members $13_1$ and $13_2$, respectively, interposed therebetween.

As a result of the construction illustrated in FIG. 8 in which the dimension of the diaphragm 1 in a direction in which the ultrasonic wave is radiated or in a direction of the length of the pins 4, 6 is of a significant magnitude, and the mount 8 has an increased thickness because of the need to support an elastic seal structure comprising the resilient member 9 and the O-ring 10, added with the resilient members $13_1$, $13_2$ interposed, in combination with the projection of the terminal pins 4, 6 in the opposite direction from the direction of radiation of the ultrasonic wave, it will be seen that the sensor base 12 in which the transducers $1_1$, $1_2$ are received must have an increased thickness, resulting in an increased length of projection from the bumper BR. This tends to cause a collision of the base 12 with other things, causing the likelihood that the transducers $1_1$, $1_2$ may not be fully functional. In the manner of use illustrated in FIG. 9*a*, any article which may collide with the base 12 can be detected by the transducer prior to its collision, allowing the vehicle to be stopped. However, it is possible that articles may crash against or collide with the vehicle during the time it is at rest. In addition, such projection stands in the way of a car washing operation. Furthermore, it will be understood that the entire diaphragm 1 must be floating from the mount 8 and the base 12, and this causes the susceptibility that dusts or dirt may find its way into the space between the internal surface of opening formed in the base 12 and the external surface of the diaphragm 1, again causing a degraded functionability of the diaphragms $1_1$, $1_2$ or their inability to operate. Removal of dust or dirt is difficult to achieve, whereby the detection of an article may be imperfect.

A manner of use is also contemplated in which a transducer is stowed inside the bumper BR so that the latter may be abutted by articles without causing malfunctioning of the transducer. Such manner is illustrated in FIG. 10*a* which shows the resulting appearance, and also in FIG. 10*b*, which is an enlarged cross section thereof. In this manner of use, a sensor base 14 is horn-shaped in an attempt to provide a restricted range for the directivity of the ultrasonic wave and to preserve the intended use of the bumper BR, namely, removing any adjacent articles and preventing a collision of an article with the car body. A transducer is mounted in the smaller end of the horn. Again, the ingress of dust or dirt into the sensor base 14 is likely, and its removal is difficult, resulting in an imperfect detection of an article or articles.

On the other hand, a transducer of the kind described has an output of a low level. Accordingly, noises may be induced upon a transmission line which transmits an output signal from the transducer to a signal processor which is located at a suitable space in a vehicle. To provide a high signal-to-noise (S/N) ratio of a sensor signal which is applied to the signal processor, it is a conventional practice to dispose an amplifier adjacent to the transducer so that the output from the transducer may be amplified to a level at which the influences of induced noises are negligible before it is transmitted to the signal processor. However, noises induced in the transducer are also amplified. Accordingly, it is desirable that noises induced in the transducer be suppressed.

SUMMARY OF THE INVENTION

It is a first object of the invention to provide an ultrasonic transducer having a reduced thickness in a direction in which ultrasonic wave is transmitted or in which ultrasonic wave is oncoming for a transducer of a devoted receiver type; a second object is to provide an ultrasonic transducer which facilitates removal or cleaning of dust or dirts when it is mounted on the outside of a car body where the deposition of such is likely; and a third object is to minimize noises which may be induced in an ultrasonic transducer itself.

In accordance with the invention, a diaphragm comprises a cup-shaped envelope which defines a space for oscillation and a planar portion which continues from the envelope. A voltage/oscillation transducer element is secured to the internal surface of the envelope. The planar portion of the diaphragm is formed with a opening extending through the thickness thereof and which permits a lead wire to be passed therethrough, thus allowing the space for oscillation around the transducer element to be substantially closed by a support plate 15 of a low resiliency which is joined to the planar portion of the diaphragm. A resilient member is joined to the external surface of the support plate. The other end of a lead wire having its one end connected to the transducer element, after passing through an opening therefor, extends along the support plate to be brought out through the lateral side of the support plate.

With this construction, the planar portion of the diaphragm is integrally secured to the support plate, allowing the cup-shaped portion to oscillate. The support plate represents a rigid body in respect to the ultrasonic oscillation, thus blocking the transmission of the ultrasonic oscillation to regions other than the diaphragm and thus enhancing the efficiency with which the ultrasonic wave is transmitted and received. As compared with the conventional construction initially mentioned, the combination of the resilient member 9, O-ring 10 and the mounting resilient member 13 is replaced by the resilient member alone in accordance with the invention, thus reducing the thickness as viewed in a direction in which the ultrasonic wave is transmitted or received to facilitate its mounting while simultaneously facilitating removal of dust or dirt from the diaphragm due to the presence of the planar portion which continues from the cup-shaped envelope.

In preferred embodiments of the invention, one electrode of the voltage/oscillation transducer element is connected to an ultrasonic transmitter circuit and/or receiver circuit through the lead wire which is brought out in the manner mentioned above while the other electrode is disposed in abutment against the diaphragm which is formed by a metallic plate as in the prior art. This electrode is normally connected to the ground or a common potential. At this end, a rivet hole is formed through the planar portion of the diaphragm, and a corresponding hole is formed in the support plate. A rivet is passed through these holes so that an electrical connection tab disposed in abutment against the external surface of the support plate can be secured in place by the rivet. The tab is connected to the ground either directly or through an electrical lead. A resilient member is joined to the external surface of the support plate so that the lead wire extending along the external surface of the support plate as well as the electrical connection tab is covered by the resilient member. To facilitate the mounting of the transducer to a desired location, which may be a bumper, for example, and to increase the mounting strength, a sheet material such as a sheet of aluminium is joined to the external surface of the resilient member. A fixture is secured to the sheet to facilitate the mounting. The sides of the support plate, resilient member and the sheet material through which the lead wire and tab are brought out are coated with an elastic insulating material which produce seals around the lead wire and the tab.

In preferred embodiments of the invention, the sheet material which is joined to the external surface of the resilient member in order to increase the mounting strength is formed of a conductive material, which is then connected to the ground. As a consequence, the lead wire is disposed within the transducer between the metallic diaphragm. The diaphragm is connected to the ground through the connection tab and the support plate, and the sheet material which is also connected to the ground, and thus is shielded, whereby they are isolated from any electric field prevailing in a space external of the transducer.

Other objects and features of the invention will become apparent from the following description of embodiments thereof with reference to the drawings.

DESCRIPTION OF PREFERRED EMBODIMENTS

Figure 1:
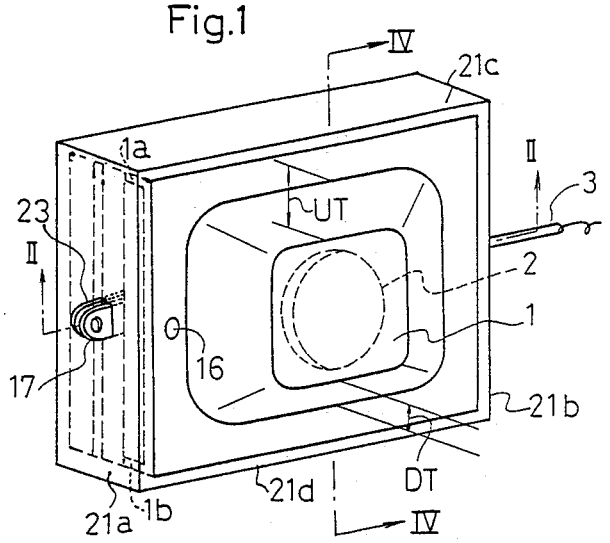
FIG. 1 is a perspective view illustrating the appearance of a first embodiment of the invention.
Figure 3:
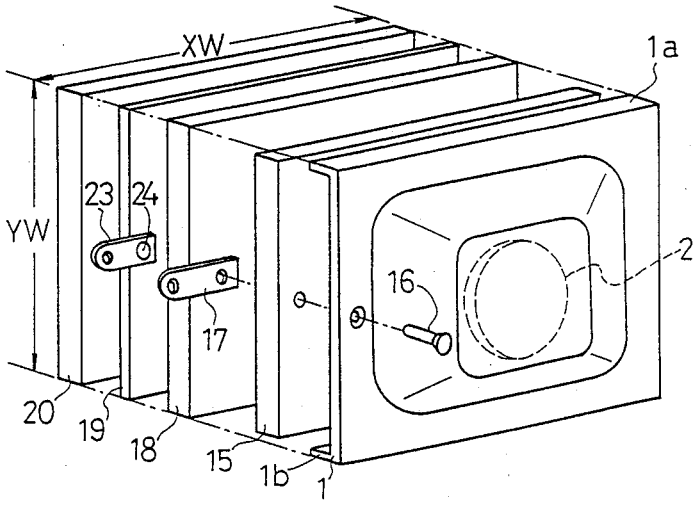
FIG. 3 is an exploded perspective view of the ultrasonic transducer shown in FIG. 1.
Figure 2:
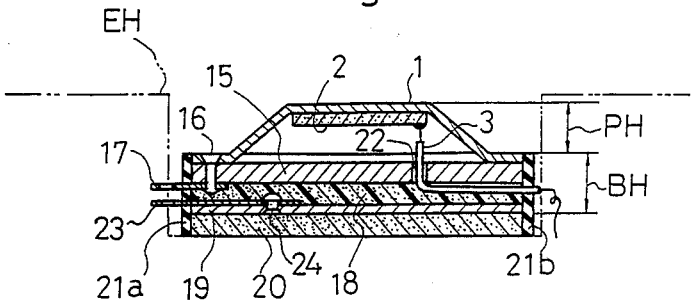
FIG. 2 is a cross section taken along the line II—II shown in FIG. 1.
Figure 4:
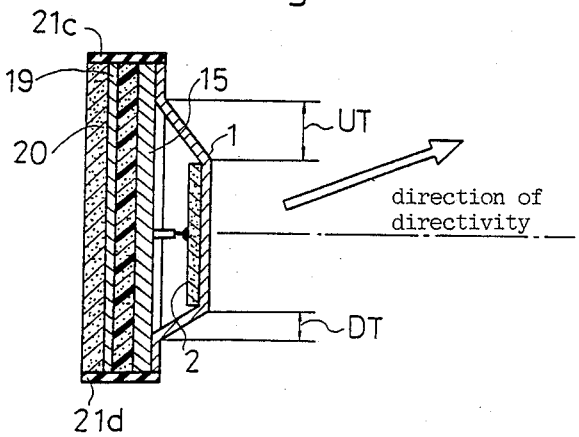
FIG. 4 is a cross section taken along the line IV—IV shown in FIG. 1.

FIG. 1 shows the appearance of a first embodiment of the invention, FIGS. 2 and 4 are cross sections taken along the lines II—II and IV—IV, respectively, and FIG. 3 shows the appearance of components before the assembly. A diaphragm 1 comprises a rectangular, thin sheet of aluminium, which is formed, by a press operation, into a cup-shaped portion of non-symmetrical frustum of cone extending from a planar portion or flange.

A disc-shaped piezoelectric element 2 or voltage/oscillation transducer element is joined to the internal surface of the forwardmost or top portion of the cup-shaped portion, with its first or surface electrode being disposed on one side and in contact with the diaphragm 1. The second electrode is disposed on the opposite side of the piezoelectric element and is connected to one end of a lead wire 3.

Along its longer sides, the planar portion of the diaphragm 1 is formed with fold-backs 1*a*, 1*b* which are bent at right angles with respect to the plane of the planar portion. The surface of the planar portion is joined to the surface of an iron plate 15 forming a support plate which serves as a rigid body with respect to oscillations produced by the diaphragm 1 and exhibiting a low resiliency which acts to isolate oscillations. The lateral edges of the iron plate 15 are joined to the fold-backs 1*a*, 1*b* along the longer sides. In this manner, the iron plate 15 encloses the internal cup-shaped space within the diaphragm 1 and forms an oscillation space therein. An opening 22 is formed to extend through the thickness of the iron plate 15 to allow the lead wire 3 to extend therethrough, the lead wire then extending along the iron plate 15 to be brought out through the shorter side of the plate 15.

Along the other short side, the planar portion of the diaphragm 1 and the iron plate 15 are formed with an opening, through which a rivet 16 extends and is crimped to secure an electrical terminal tab 17 in place, thus joining it to the iron plate 15. Since the diaphram 1 is metallic (a thin sheet of aluminium) and thus is conductive as are the rivet 16 and the iron plate 15, it will be seen that the tab 17 is electrically connected to one electrode of the piezoelectric element 2 through the rivet 16 and the diaphragm 1 and also through the iron plate 15 and the diaphragm 1.

Joined to the other surface of the iron plate 15, which faces away from the piezoelectric element 2, is a rigid, foamed resin plate 18 having a high resiliency and including a multitude of air pores, highly effective in absorbing oscillations produced by the transducer support. A thin sheet of aluminium 19 is joined to the resin plate 18 and defines a bottom plate for the transducer. Additionally, a permanent magnet plate 20, which is constructed as having N-pole along its one of shorter sides and S-pole along the other shorter side, is joined to the aluminium sheet 19 in order to facilitate the mounting. It is to be noted that the magnet plate is formed so as to be relatively flexible. Adjacent to its one edge, the aluminium sheet 19 is formed with an opening, through which a rivet 24 is passed and is crimped to secure an electrical terminal tab 23 to the sheet 19.

The external lateral edges of the diaphragm 1, iron plate 15, resin plate 18, aluminium sheet 19 and permanent magnet plate 20, including both their shorter and longer sides, are coated by flexible molded resins 21*a*, 21*b*, 21*c* and 21 *d* which provide seals around the electrical terminals.

Referring to FIG. 3, the assembly of the transducer will be described. The iron plate 15 is joined to the diaphragm 1 having the piezoelectric element 2 secured thereto. The lead wire 3 electrically connected to the piezoelectric element 2 is passed through the opening 22 formed in the iron plate 15, and after securing the diaphragm 1 and the iron plate 15 together, the rivet 16 is crimped to secure the tab 17 to the rear surface of the iron plate 15. The aluminium sheet 19 having the tab 23 secured thereto by means of the rivet 24 and the resin plate 18 which is joined with the permanent magnet plate 20 are then joined to the rear surface of the iron plate 15. The lateral end faces of the shorter sides of the assembly are then coated by molding resins 21*a*, 21*b*.

The assembled transducer is then inserted into a transducer mounting opening EH (see FIG. 2) formed in a bumper comprising an iron frame, the surface of which is coated with a resin material. When so inserted, the permanent magnet of the transducer is coupled to the iron frame of the bumper. The lead wire (not shown) connected to the tab 17 and the lead wire 3 are passed through an opening formed in the iron frame of the bumper so as to be wired on the rear side of the bumper. Any dust or dirt which may find their way into the mounting opening can be easily removed since a space is left between the cup-shaped portion and the mounting opening EH commensurate with the size of the planar portion.

It is to be understood that the purpose of the permanent magnet 20 is to facilitate the mounting, and that it may be eliminated. In either instance, the resin plate 18 isolates oscillations which may be transmitted from the bumper to the transducer. The space for oscillation of the diaphragm communicates through the lead wire receiving opening 22 to a groove formed in the resin plate 18 to pass the lead wire, whereby the resin plate 18 is effective to absorb any pressure of vibration from the diaphragm 1. This substantially isolates the transmission of ultrasonic oscillations from the aluminium sheet 19. Since the planar portion of the diaphragm is joined to the iron plate 15, it cannot oscillate while the cup-shaped portion oscillates. Thus, oscillations produced by the diaphragm 1 are reflected by the iron plate 15, and are prevented from being transmitted to the resin plate 18, thus reducing the attenuation. This contributes to reducing the thickness of the transducer without degrading the voltage/oscillation conversion efficiency of the diaphragm 1.

The electrical terminal tab 23 secured to the aluminium sheet 19 is connected through a lead wire, not shown, to the ground which is defined by the car body. Similarly, the electrical terminal tab 17 connected to the diaphragm 1 is connected through a lead wire, not shown, to the ground, again defined by the car body. By connecting the aluminium sheet 19 and the diaphragm 1 to the ground and thus connecting the outer walls of the transducer to the ground, the interior of the transducer is electrically isolated. Accordingly, the transducer element 2 and the lead wire 3 is less susceptible to electromagnetic waves which may be applied externally of the transducer to induce noises thereon.

It will be seen from FIG. 4 that the cup-shaped portion of the diaphragm 1 is non-symmetrical as viewed in the vertical direction, whereby the diaphragm has a direction of directivity which deviates from a perpendicular to the front surface of the diaphragm 1, or obliquely upward in the present embodiment. The non-symmetrical configuration of the cup-shaped portion allows the direction of directivity to be arbitrarily established.

Figure 5A:
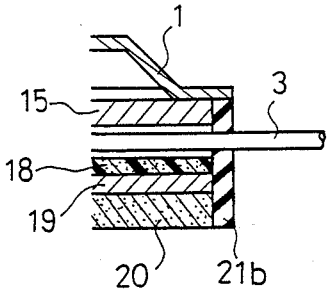
FIGS. 5*a*, 5*b* and 5*c* are cross sections of only a molded portion of several modifications of the first embodiment.
Figure 5B:
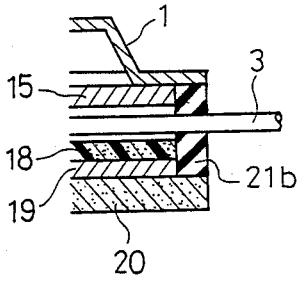
Figure 5C:
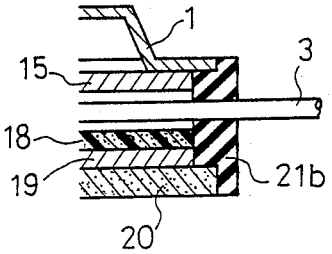

A specific example of the transducer according to the invention has been constructed using the parameters as given below:

XW (length of longer side): 28 mm
YW (length of shorter side): 25 mm
Thickness of diaphragm 1: 0.8 mm
PH (height of cup): 2 mm Element 2 mounting surface (forwardmost surface): 12 mm×12 mm
Bottom of cup portion: long side 22 mm×short side 19 mm
UT: 5 mm
DT: 2 mm (non-symmetrical vertically, but symmetrical laterally)
Thickness of iron plate 15: 1.6 mm
Thickness of resin plate 18 (urethane): 2 mm
Thickness of aluminium sheet 19: 0.8 mm
Thickness of permanent magnet plate 20: 2 mm
Height from lower surface of resin plate 18 to the top (wave transmitting end): 6.4 mm
Height from bottom (lower surface of magnet plate 20) to the top (wave emitting end): 9.2 mm In the described embodiment, the external lateral edges of the transducer are molded with sealing resins 21*a* to 21*d* into a rectangular configuration. The strength of such molds can be further increased by joining the upper end face of the shielding resin 21*b* with the lower surface of the diaphragm 1, by embedding the sealing resin 21*b* between the lower surface of the diaphragm 1 and the upper surface of the permanent magnet 20, or by embedding the sealing resin 21*b* between the lower surface of the diaphragm 1 and the upper surface of the permanent magnet 20 and utilizing part of the sealing resin 21*b* to cover the external surfaces thereof, as illustrated in FIGS. 5*a*, 5*b* and 5*c*, respectively.

Figure 6A:
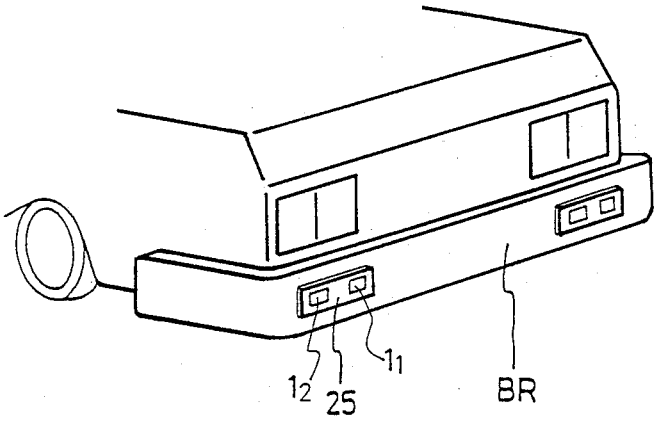
FIG. 6*a* is a perspective view showing part of a vehicle on which an ultrasonic transducer according to a second embodiment of the invention is mounted.
Figure 6B:
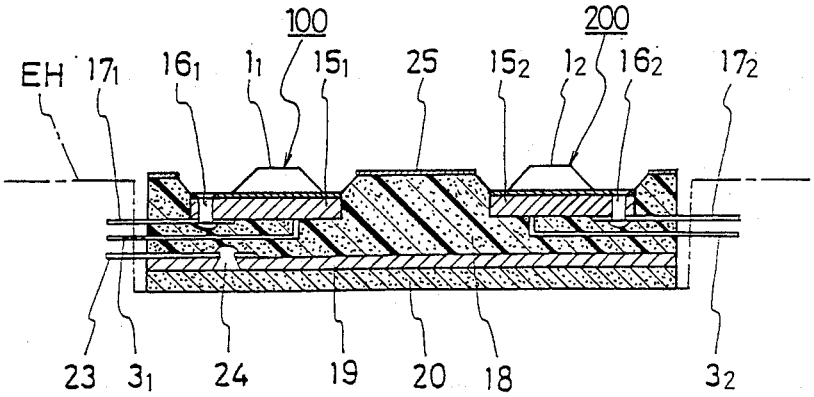
FIG. 6*b* is a cross section of the ultrasonic transducer shown in FIG. 6*a*.

FIG. 6*a* shows the appearance of vehicle which incorporates a second embodiment of the invention, the detail of which is shown in FIG. 6*b*. In this embodiment, a pair of transducers 100 and 200 of an identical construction are mounted on a single conductive sheet 19. Diaphragms $1_1$ and $1_2$ are formed to an identical size, each comprising a rectangular thin sheet of aluminium which is formed into a cup-shaped portion in the form of a non-symmetrical frustum of cone which projects from a planar portion, by a press operation. While not shown, piezoelectric elements having matching characteristics, and operating as voltage/oscillation transducer elements, are disposed within the respective cup-shaped portions. One electrode on the surface of each piezoelectric element is electrically connected to an associated one of diaphragms $1_1$, $1_2$ and thence connected through a rivet $16_1$ or $16_2$ to an electric terminal tab $17_1$ or $17_2$. The other electrode on the surface of the piezoelectric element is connected to one end of an associated lead wire $3_1$ or $3_2$.

The diaphragms $1_1$, $1_2$ are joined to iron plates $15_1$, $15_2$, which serve as support plates, and as before, the iron plates $15_1$, $15_2$ are formed with an opening which allows a rivet $16_1$ $16_2$ to pass therethrough, and another opening which allows a lead wire $3_1$ or $3_2$ to pass therethrough. A foamed synthetic resin plate 18 having a multitude of air pores which provides an enhanced oscillation absorbing effect is joined in common to the surfaces of the iron plates $15_1$ and $15_2$ which face away from the respective diaphragms 1. A thin sheet of aluminium 19 is joined to one surface of the resin plate 18 so as to define a bottom plate which is common to the both transducers. The sheet 19 is formed with an opening adjacent to one edge, through which a rivet 24 passes and is crimped to secure an electrical terminal tab 23 to the sheet 19. The surface of the aluminium sheet 19 which faces away from the resin plate 18 is joined with a permanent magnet plate 20 having a relatively high flexibility in order to facilitate the mounting. The surface of the resin plate 18 which faces the aluminium sheet is adhesively bonded with a metallic fixing plate 25.

The assembly including the pair of transducers constructed in the manner mentioned above is inserted into a transducer mounting hole EH formed in a bumper BR, which comprises an iron frame, the surface of which is covered with a resin layer. As the assembly is inserted, the permanent magnet is coupled to the iron frame of the bumper. Lead wires, not shown, connected to the tab 17 and the lead wire 3 extend through an opening formed in the iron frame so as to be connected to a wiring located on the rear side of the bumper. In this manner, the lead wires are electrically shielded by the iron frame of the bumper BR. The tab 23 connected to the aluminium sheet 19 is connected through a lead wire, not shown, to a car body, preferably to the iron frame of the bumper BR, which serves as an electrical ground.

In the second embodiment, the provision of the pair of transducers allows a simplification in the adjustment of a signal processor which is otherwise complicate to achieve. By extending the area of the fixing plate 25 to cover the transducer mounting opening EH, the ingress of mud or dirts into the mounting opening can be prevented. In addition, connecting the fixing plate 25 to the electrical ground improves the insusceptibility of the assembly to induced noises.

While the pair of transducers are disposed on the common resin plate 18 in this embodiment, the number of transducers need not be limited to two. In addition, while the pair of transducers have been described as having matching characteristics, this is not essential.

Figure 7:
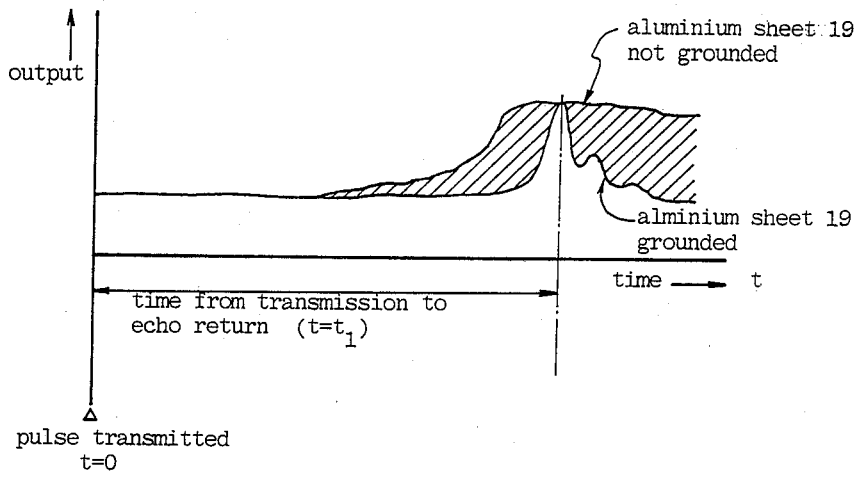
FIG. 7 graphically shows the response or the reception level of the ultrasonic transducer shown in FIG. 6*b* when it transmits ultrasonic waves and receives ultrasonic waves which are reflected from an object that is located forwardly thereof.
Figure 8:
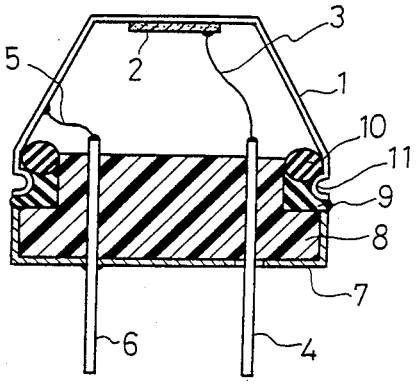
Fig. 8 Prior art
FIG. 8 is a longitudinal section of a conventional ultrasonic transducer.
Figure 9A:
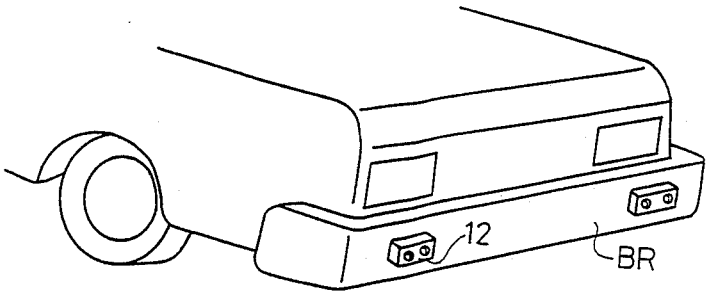
Fig.9a prior art
FIG. 9*a* is a perspective view of part of a vehicle on which the transducer shown in FIG. 8 is mounted.
Figure 9B:
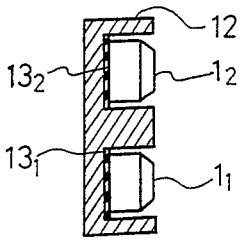
Fig.9b prior art
FIG. 9*b* is a cross section of a sensor base shown in FIG. 9*a;*
Figure 10A:
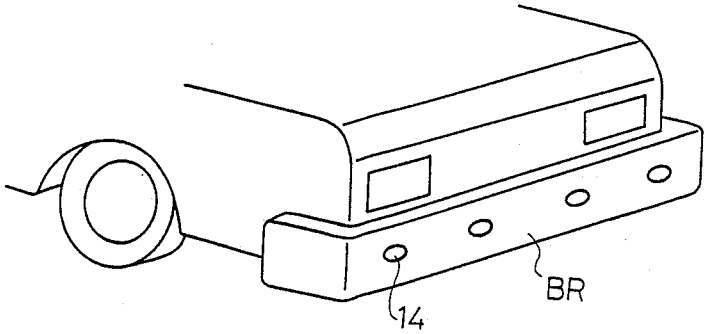
Fig.10a prior art
FIG. 10*a* is a perspective view of part of a vehicle in which an ultrasonic transducer is mounted thereon.
Figure 10B:
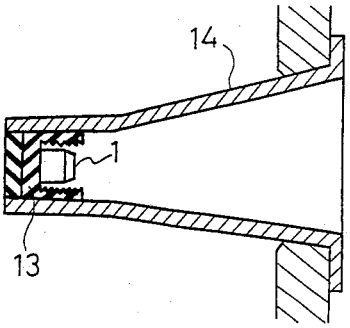
Fig.10b prior art
FIG. 10*b* is a cross section of the sensor base of the transducer shown in FIG. 10*a*.

FIG. 7 graphically shows the results of experiments which have been conducted to confirm the grounding effect of the metal plate 19 shown in FIG. 6*b*. When the aluminium sheet 19 is connected to the ground, an echo or ultrasonic wave which is reflected by an object to be determined is detected at $t=t_1$ after the ultrasonic pulse has been transmitted from the transducer at $t=0$. In general, in a technique to determine the distance to an object to be determined utilizing the reflection of the ultrasonic wave, it is a common practice to increase the receiver sensitivity with time from the transmission ($t=0$) of the ultrasonic pulse. Accordingly, if the aluminium sheet 19 is not connected to the ground, noises induced will be amplified as the sensitivity increases, resulting in a failure to provide a simple discrimination of the reflection from the noises.

As described, in the ultrasonic transducer of the invention, a diaphragm comprises a cup-shaped portion which defines an envelope for the space of oscillation and which continues from and projects from a planar portion. The diaphragm is joined to a support plate having a low resiliency. A lead wire extends along the support plate to be brought out along the lateral side thereof. As a consequence, the transducer has a reduced elevation as viewed in the direction in which the ultrasonic wave is transmitted, and under the condition that the transducer is mounted on an object such as a vehicle, the elevation as viewed in the transmission of the ultrasonic wave will be reduced since the electrical terminals extend in the lateral direction. Consequently, when the ultrasonic wave transmitting surface of the transducer is exposed to the atmosphere, the likelihood of causing a collision of the transducer with another article is reduced as is the risk of being damaged. In addition, when the transducer is mounted in the opening EH shown in FIG. 2, for example, the provision of the planar portion around the cup-shaped portion of the diaphragm provides an increased space between the cup-shaped portion and the edge of the opening EH, facilitating removal of any mud or dirt which may find their way into the opening EH. In addition, the transducer element and conductive sheet or plates which are disposed along the lead wires are connected to the ground, whereby the transducer element and its connected lead wire are electrically shielded, making the transducer less susceptible to the influences of induced noises.

What I claim is:

1. An ultrasonic transducer comprising:

diaphragm means including a frustroconically-shaped envelope defining an oscillation space therein, said envelope having a base portion and a top portion, and a planar flange extending from said base portion of the envelope;

an ultrasonic transducing element, having first and second electrodes disposed on opposite sides of said element, secured to said top portion of the envelope within said space with said first electrode in contact with said top portion;

a support plate 15 having first and second sides, said first side being joined to the planar flange of the diaphragm means to enclose the transducing element within the oscillation space, the support plate having a low resiliency and having an opening extending therethrough in a direction perpendicular to the first and second sides;

a resilient member having first and second sides, said first side being joined to the second side of the support plate;

and a lead wire connected to the second electrode of the transducing element and extending through the opening in the support plate and extending laterally therealong and emerging exteriorly from said transducer.

2. An ultrasonic transducer according to claim 1 wherein the frustroconically-shaped envelope is non-symmetrical.

3. An ultrasonic transducer according to claim 1, further including a permanent magnet plate having first and second side, said first side being joined to the second side of the resilient member.

4. An ultrasonic transducer comprising diaphragm means including a frustroconically-shaped envelope defining an oscillation space therein, said envelope having a base portion and a top portion, and a planar flange extending from the base portion of the envelope;

an ultrasonic transducing element, having first and second electrodes disposed on opposite sides of the element, secured to said top portion of the envelope within said space with said first electrode in contact with said top portion;

a support plate having first and second sides, said first side being joined to the planar flange of the diaphragm means to enclose the transducing element within the space, the support plate having a low resiliency and having an opening extending therethrough in a direction perpenicular to the first and second sides, said support plate having means for connecting the plate to an electrical ground;

a resilient member having first and second sides, said first side being joined to the second side of the support plate;

a conductive plate having first and second sides, said first side being joined to the second side of the resilient member and having one end adapted to be connected to an electrical ground;

and a lead wire connected to the second electrode of the transducing element and extending through the opening in the support plate and extending laterally therealong and emerging exteriorly from said transducer.

5. An ultrasonic transducer according to claim 4 wherein the frustroconically-shaped envelope is non-symmetrical.

6. An ultrasonic transducer according to claim 4, further including a permanent magnet plate having first and second sides, said first side being joined to the second side of said conductive plate.

* * * * *